United States Patent [19]

Hildeman et al.

[11] Patent Number: 4,732,610

[45] Date of Patent: Mar. 22, 1988

[54] AL-ZN-MG-CU POWDER METALLURGY ALLOY

[75] Inventors: Gregory J. Hildeman, Murrysville; Linda C. Labarre, Penn Hills; David J. Brownhill, Plum Borough; Arshad Hafeez, Murrysville, all of Pa.

[73] Assignee: Aluminum Company of America, Pittsburgh, Pa.

[21] Appl. No.: 833,222

[22] Filed: Feb. 24, 1986

[51] Int. Cl.[4] ..... B22F 1/00

[52] U.S. Cl. ..... 75/249; 75/247; 75/251; 75/255; 419/23; 419/38; 419/48; 420/532

[58] Field of Search ..... 75/251, 247, 249, 255; 420/532; 419/23, 38, 48

[56] References Cited

U.S. PATENT DOCUMENTS

| | | | |
|---|---|---|---|
| 3,954,458 | 5/1976 | Roberts | 75/249 |
| 4,297,136 | 10/1981 | Pickens et al. | 75/234 |
| 4,435,213 | 3/1984 | Hildeman et al. | 75/249 |
| 4,615,735 | 10/1986 | Ping | 419/63 |

*Primary Examiner*—Stephen J. Lechert, Jr.
*Attorney, Agent, or Firm*—Daniel A. Sullivan

[57] ABSTRACT

Loose metal particles, or a consolidated metal particle composition, of an aluminum alloy consisting essentially of about 5 to 13% zinc, 1 to 3.5% magnesium, 0.5 to 3.0% copper, with iron being present up to 0.5%, with silicon being present up to 0.4%, plus nickel or cobalt or both being present in an amount effective essentially to place the iron in the incoherent dispersoid $Al_9(Fe,M)_2$, M being nickel or cobalt or both, M being present up to 0.75%, plus means being present for forming coherent dispersoids, said means being present up to 1%, balance aluminum.

22 Claims, 6 Drawing Figures

AL-ZN-MG-CU POWDER METALLURGY ALLOY

TECHNICAL FIELD

This invention relates to the field of powder metallurgy and more particularly to an alloy having properties of particular benefit for powder metallurgical purposes. While this field has come to be known as "powder" metallurgy, the generic term today is more precisely "particle", since particles from atomization, splat cooling and ribbon casting share the characteristic of high cooling rate during the liquid to solid transformation and thus exhibit many properties in common. The term "particle" is used herein with the intent that it be construed in accordance with its generic meaning.

DISCLOSURE OF INVENTION

According to the invention, there is provided, in the form of loose metal particles or a consolidated metal particle composition thereof, a high-strength, damage tolerant 7XXX series aluminum powder metallurgy alloy consisting essentially of about 5 to 13% zinc, 1 to 3.5% magnesium, 0.5 to 3.0% copper, with iron being present up to 0.5%, with silicon being present up to 0.4%, plus nickel or cobalt or both being present in an amount effective essentially to place the iron in the incoherent dispersoid $Al_9(Fe,M)_2$, M being nickel or cobalt or both, M being present up to 0.75%, plus means being present for forming coherent dispersoids, said means being present up to 1%, balance aluminum.

Percentages herein are on a weight basis, unless stated otherwise.

Use of the term "essentially" in the claims appended hereto is intended to permit the inclusion of incidental ingredients, such as impurities, which do not materially affect the basic and novel characteristics of the subject matter defined by the claims.

The alloy of the invention has a combination of strength, toughness and resistance to fatigue and corrosion that is greater than that of other ingot or powder metallurgy alloys used currently in aerospace applications.

As noted above, the alloy of the invention basically contains defined percentages of zinc, magnesium, copper, and aluminum. Metallurgically speaking, this composition places the alloy of the invention in the category of precipitation hardening aluminum alloys which are hardened by precipitation of phases containing Zn, Mg and Cu, such as $Mg(Zn,Cu)_2$ and $Mg_3Zn_3Al_2$.

The insoluble element iron is also present in the alloy of the invention, but it is not permitted to exceed 0.5%. Along with this iron content, the alloy of the invention additionally contains up to 0.75% Ni, the purpose being to form $Al_9(Fe,Ni)_2$ dispersoid, in preference to $Al_7Cu_2Fe$. $Al_9(Fe,Ni)_2$ is preferred because it has greater thermodynamic stability (its melting point is 809° C. compared with 590° C. for $Al_7Cu_2Fe$). $Al_7Cu_2Fe$ is also undesirable due to its effect on reducing the amount of Cu to the $Mg(Zn,Cu)_2$ phase, which is responsible for precipitation strengthening. As a consequence of rapid solidification, the $Al_9(Fe,Ni)_2$ dispersoids which form are generally less than 0.5 microns in size. The fine size and uniform spacing of the $Al_9(Fe,Ni)_2$ dispersoids improve fracture toughness compared to ingot metallurgy alloys which contain coarse $Al_7Cu_2Fe$ intermetallic particles due to segregation during slow freezing of the alloy. These coarse particles are undesirable in aerospace alloys because they reduce fracture toughness.

Preferably, the weight ratio Ni/Fe is between 0.8:1 and 4.5:1 which maintains the ratio in the range of stoichiometry for $Al_9(Fe,Ni)_2$ defined by G. V. Raynor and P. C. Pfeil, *J. Inst. of Metals,* Vol. 73 (1947), p. 415. In the $Al_9(Fe,Ni)_2$ phase, Co can be substituted for Fe, Ni or both elements.

Preferably, the iron content does not exceed 0.2%, and, desirably, it is at 0.1% or below.

The insoluble element silicon is also present in the alloy of the invention, but it is not permitted to exceed 0.4%. Preferably, the silicon content does not exceed 0.2%, and, desirably, silicon content is at 0.1% or below. Thus, silicon is not desired, particularly because it leads to increased amounts of $Mg_2Si$, which lowers toughness.

The alloy also contains other dispersoid-forming elements tending to form dispersoids of varying degrees of coherence with the aluminum lattice for strengthening and for controlling grain size, i.e. retarding recrystallization to maintain a fine grain size. Examples are the slightly soluble elements Zr, V, Hf, Ta and Ti. In the case of these elements, a preferred upper limit lies in the range 0.6 to 1.0%.

In the case of these coherent dispersoid forming elements, particularly Zr, it may be beneficial, as disclosed by Zedalis and Fine, *Scripta Met.,* Vol. 17, p. 1247 (1983) to have combinations of elements present such that the ratio of elements modifies the lattice parameter of the dispersoid to improve coherency with the aluminum matrix.

Oxygen will also typically be present in the alloy. Preferably, its presence does not exceed 1%.

Preferably, impurities are held to others each 0.05%, others total 0.15%, which are limits of common usage in the art.

Articles of the alloy of the invention may be produced by consolidating its particles into hot pressed billets which can be rolled, extruded or forged. The particles are preferably formed by a rapid solidification process, where molten metal of the correct composition is atomized, splat cooled, or ribbon cast such that the molten metal cools for solidification at a rate generally in the range $10^3$ to $10^6$° C./sec A preferred basic procedure for fabrication of the alloys of the invention is as follows:

(1) melting and alloying, (2) atomizing and screening to make −100 mesh powder with a mass median diameter of 5 to 60 microns as measured by a Fisher subsieve sizer, (3) compacting the powder to 65–95% density to form the green compact, (4) degassing the green compact by heating in a flowing atmosphere or vacuum (see, e.g. U.S. Pat. Nos. 3,544,392 and 4,435,213), (5) hot pressing to 95 to 100% density, and then (6) hot working.

In the atomizing, control of oxygen content in the atomizing gas to a level below that of air may be desirable to limit oxide content of the powder and thereby improve bonding of the compacted particles: a certain amount of oxide should be present, however, to provide a minimum protective oxidation layer on the particle surfaces (see e.g. U.S. Pat. No. 4,457,881, column 5, lines 15 to 29).

To obtain the green compact, the powders may be isostatically compressed into a cohesive or coherent green compact shape for ease of handling. This can be effected by placing the powder within a bag, such as a rubber or plastic bag, which in turn is positioned within a hydraulic media for transmitting pressure through the bag to the powder. A pressure within the range of about 30 to 400 MPa can be applied to the hydraulic media to compress the powder into a cohesive shape of about 60 to 90 or 95% of full density. The resulting product is referred to as the green compact. The temperature for this green compact compression is preferably room temperature, or a temperature not over 150° C., preferably not over 50° C. Organic binders are preferably avoided in the green compact. The advantage of isostatic compaction is providing a coherent shape for further processing.

Preferably with, less preferably without, the preliminary isostatic compaction, hot pressing to substantially full density is done at a relatively high temperature of over 300° C., and preferably at least 350° or 400° C. When referring to substantially full density, it is intended that the compacted billet be substantially free of porosity with a density equal to 95% or more of the theoretical solid density. In some cases it is preferred to conduct the full density compaction under vacuum conditions or in a relatively non-oxidizing gaseous atmosphere. Vacuum compaction can be beneficial to the toughness of the powder product and is preferred where toughness is of high importance. In this procedure the powder or isostatically compacted green compact is placed in a chamber which is evacuated down to a pressure level of 1 torr, preferably $10^{-1}$ or $10^{-2}$ or less (1 torr equals 1 millimeter of Hg at 0° C.). The material may be compressed to substantially full density at the desired elevated temperature while it is still in the evacuated chamber.

Alternatively, heating to the hot compression temperature may be done rapidly by induction heating, as taught in U.S. Pat. No. 4,435,213.

Subsequent hot working may be done by extruding, hot coining, forging, rolling or the like. Alternatively, or supplementally, the hot-pressed article can be machined into a useful shape. Additional hot working may be helpful after hot pressing. It is preferred that the hot-pressed compact be worked by an amount equivalent to a reduction in cross section of at least 25%, preferably 50 or 60% or more, where practical, since such favors improved properties. Preferred temperatures for hot working range from about 250° to 525° C. Below 250° C., the material tends to be too hard for hot working; above 525° C., there is danger of melting.

Heat treatment of the alloy of the invention is similar to that of other 7000-series alloys. For solution heat treatment, the alloy, as done in U.S. Pat. No. 3,563,814, is heated to a temperature within the range of about 400° to 540° C., but below the temperature of incipient melting, and held within that range for a length of time sufficient to obtain substantially complete solution of zinc, magnesium and copper. Various quenches may be used to retain varied amounts of the solution heat treatment. A cold water quench is suitable. Boiling water and polymer liquid quenches may be used as well.

Natural aging may be applied. An artificial aging, peak strength condition, the so-called T6 aged condition, is achieved by heating the solution heat treated alloy at 95° to 135° C. for times 1 to 200 hours. A T7 temper, which lowers strength but improves properties related to damage tolerance such as toughness and stress corrosion cracking resistance is achieved by supplementing the T6 heat treatment with additional aging at 135° to 175° C. for times from 0.5 to 100 hours.

BRIEF DESCRIPTION OF DRAWINGS

Specifically, FIG. 1 is a comparison of typical fracture toughness vs. tensile yield strength for high strength aluminum alloy extruded shapes, 0.6–3.8 cm (0.25–1.50 In) thick with CW67 and XX78 extrusions.

FIG. 2 presents fractured toughness and yield strength for 7XXX P/M versus 7075 I/M forgings.

FIG. 3 provides the fracture toughness versus yield strength relationship for high strength 7XXXX I/M and P/M alloys in forgings.

FIG. 4 shows results of ASTM G44-75 stress corrosion cracking tests of short transverse tensile bars from web-rib die forgings (Alcoa Die 16610) replicate specimens were exposed 30 days with alternate immersion in a 3.5% NaCl solution.

FIG. 5 is a comparison of axial-stress notch-fatigue data for P/M alloys CW67-T7, XX78-T7, 7090-T7E71 and 7091-T7E69 extrusion with I/M alloys 2024-T351 rod and bar and 7075T73XXX products at room temperature.

FIG. 6 is a spectrum fatigue ranking.

BEST MODE FOR CARRYING OUT THE INVENTION

The best mode for carrying out the invention is illustrated by the following examples:

EXAMPLES I and II

Alloys according to the invention, having compositions as designated for alloys CW67 and XX78 in Table I, were formed by atomizing molten metal, consolidated into green compacts, vacuum degassed by heating, and hot-compacted into billet. The alloys were then extruded to 3.8 by 11.4 cm bars or forged using a web-rib die (Alcoa die 16610). The extrusions and forgings were heated for purposes of solution heat treatment at 488° C. for 1 to 2 hours, followed by cold water quench. The solution heat treated extrusions were next given a 2% stretch for the purpose of relieving residual stress. The forgings were compression stress relieved by restriking the solution heat treated and cold water quenched forgings in the die. A T7 temper was achieved by heating 24 hours at 121° C., followed by 1 to 2 hours at 163° C. To verify the attainment of a T7 stress corrosion cracking-resistant temper, short transverse tensile bars from forgings and extrusions of alloys CW67 and XX78 were tested according to ASTM G44-75 in an alternate immersion stress corrosion cracking test. Under these conditions, replicate specimens from each alloy and product lasted 30 days without failure, under an applied stress of 310 MPa.

TABLE I

| | Nominal Compositions* of 7XXX Aluminum Alloys | | | | | | | | | | |
|---|---|---|---|---|---|---|---|---|---|---|---|
| Alloy | Zn | Mg | Cu | Co | Cr | Zr | Ni | Fe | Si | O | Al |
| 7075 I/M | 5.6 | 2.5 | 1.6 | — | 0.23 | — | — | 0.15 | 0.10 | — | Bal. |
| 7050 I/M | 6.2 | 2.2 | 2.3 | — | — | 0.12 | — | 0.06 | 0.05 | — | Bal. |

TABLE I-continued

| Alloy | Nominal Compositions* of 7XXX Aluminum Alloys | | | | | | | | | | |
|---|---|---|---|---|---|---|---|---|---|---|---|
| | Zn | Mg | Cu | Co | Cr | Zr | Ni | Fe | Si | O | Al |
| 7090 P/M | 8.0 | 2.5 | 1.0 | 1.5 | — | — | — | 0.06 | 0.05 | 0.35 | Bal. |
| 7091 P/M | 6.5 | 2.5 | 1.5 | 0.4 | — | — | — | 0.06 | 0.05 | 0.35 | Bal. |
| CW67 P/M | 9.0 | 2.5 | 1.5 | — | — | 0.14 | 0.1 | 0.06 | 0.05 | 0.35 | Bal. |
| XX78 P/M | 7.5 | 2.2 | 2.0 | — | — | 0.14 | 0.1 | 0.06 | 0.05 | 0.35 | Bal. |

*Elements in Wt %
"I/M" = "produced by ingot metallurgy"
"P/M" = "produced by powder metallurgy"

Figure 1:
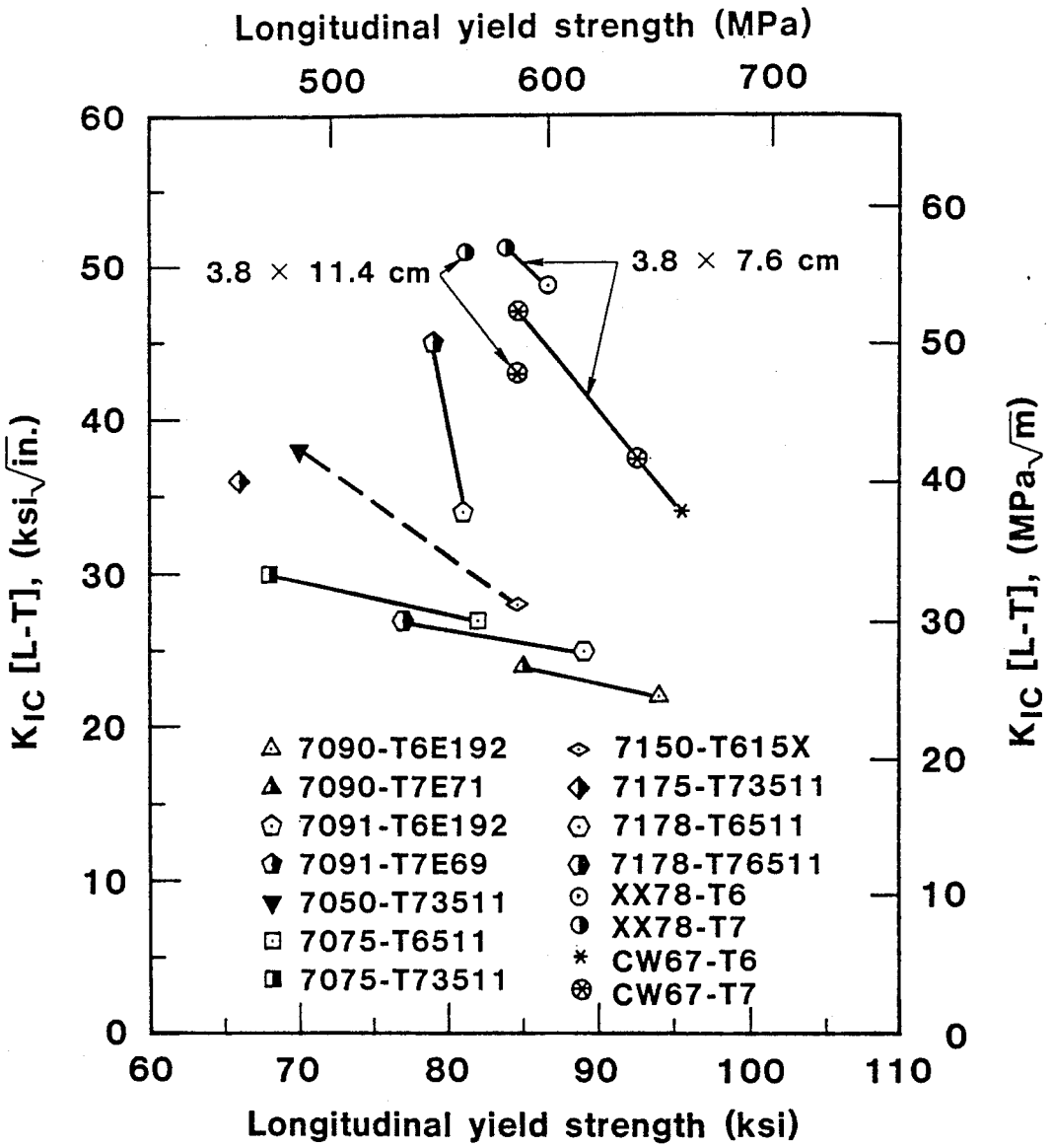
FIGS. 1 to 6 are graphs illustrating the superior and unique combinations of properties of the alloy of the invention.

FIG. 1 compares the yield strength (per ASTM B557) and fracture toughness (per ASTM E399) of the alloys of the invention with other, commercial high-strength 7000 series ingot and powder metallurgy extruded alloys. The combinations of strength and toughness of alloys CW67 and XX78 in the T6- and T7-tempers are examples which demonstrate advantages of the invention compared to the other alloys.

Figure 2:
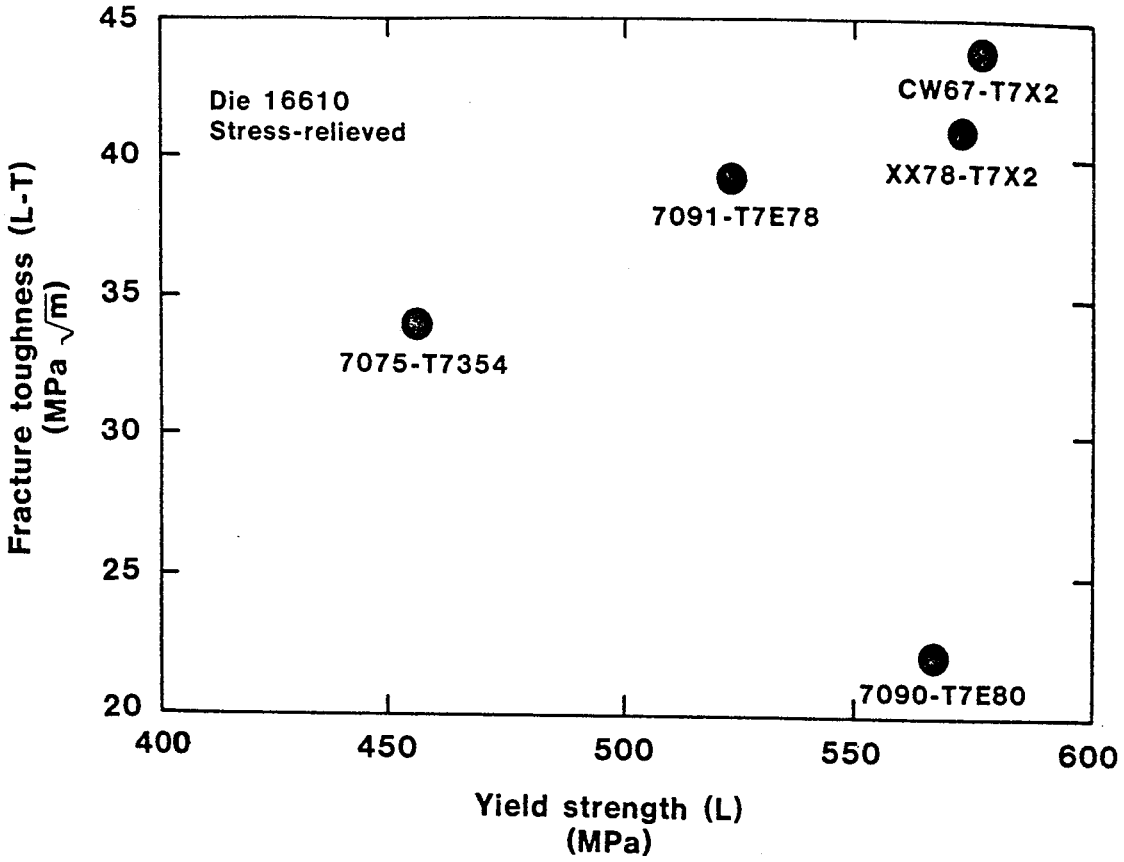

FIG. 2 is a plot of longitudinal yield strength and L-T toughness data listed in Table II for die forged 7000 alloys in the T7 temper. Note the exceptional combination of strength and toughness of CW67 and XX78 as compared, for instance, to powder metallurgy alloys 7090, 7091 and ingot metallurgy alloy 7075.

TABLE II

Comparisons of Mechanical Properties*, Web-Rib Alcoa Die 16610, Advanced 7XXX P/M-Alloys CW67, XX78, 7090, 7091 with I/M-7075

| Alloy/ Temper** | Test Direction | U.T.S.* (MPa) | Y.S.* (MPa) | E* (%) | KIC (MPa √m) | SCC*** (MPa) |
|---|---|---|---|---|---|---|
| 7075- | L | 530 | 456 | 13 | 34+ | — |
| T7354 | LT | 520 | 447 | 12 | — | — |
| | ST | 510 | 441 | 8 | 28 | 290 |
| 7090- | L | 613 | 565 | 12 | 22 | — |
| T7E80 | LT | 613 | 552 | 13 | — | — |
| | ST | 579 | 520 | 7 | 19 | 310 |
| 7091- | L | 586 | 524 | 13 | 38 | — |
| T7E78 | LT | 596 | 541 | 13 | — | — |
| | ST | 545 | 476 | 7 | 30 | 310 |
| CW67- | L | 606 | 579 | 14 | 44 | — |
| T7X2 | LT | 606 | 572 | 15 | — | — |
| | ST | 572 | 531 | 9 | 34 | 310 |
| XX78- | L | 614 | 572 | 17 | 41 | — |
| T7X2 | LT | 614 | 572 | 17 | — | — |
| | ST | 558 | 510 | 10 | 38 | 310 |

Figure 3:
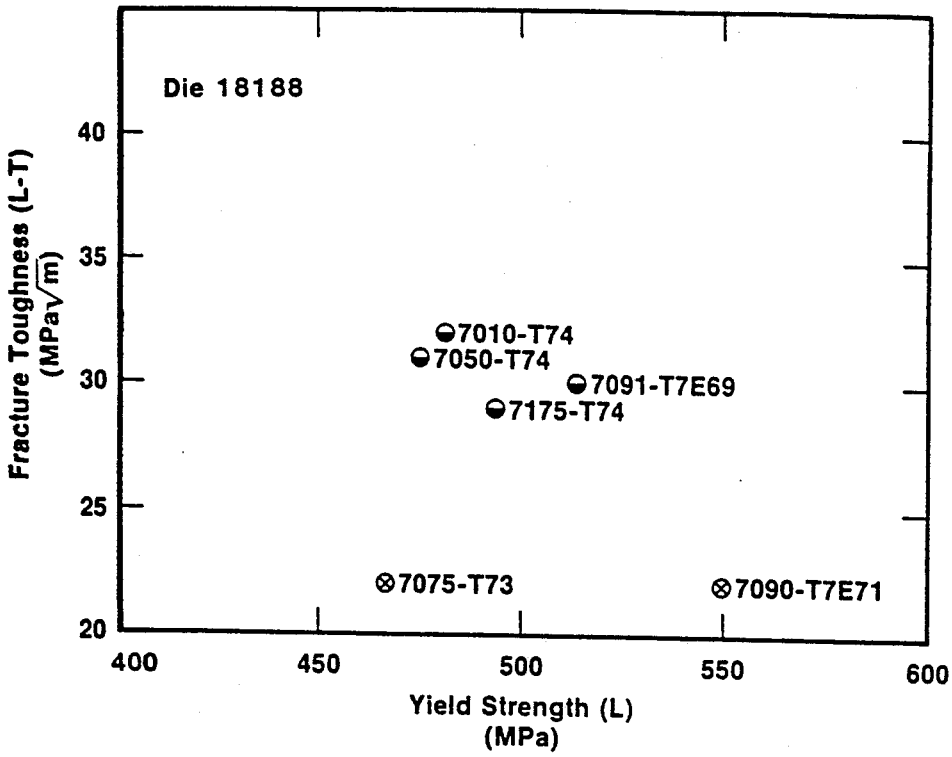

*Average Properties
**Stress-Relieved Temper
***Stress Level for No Failure in Alternate Immersion
+$K_Q$ FIG. 3 is presented for the purpose of showing how the mechanical properties of alloys CW67 and XX78 relate to those of other 7000 series forged alloys. The position of CW67 and XX78 in FIG. 2 relative to alloy 7091 allows us to realize from FIG. 3 the improved strength and toughness combination which CW67 and XX78 provide relative to these other commercial alloys too.

Figure 4:
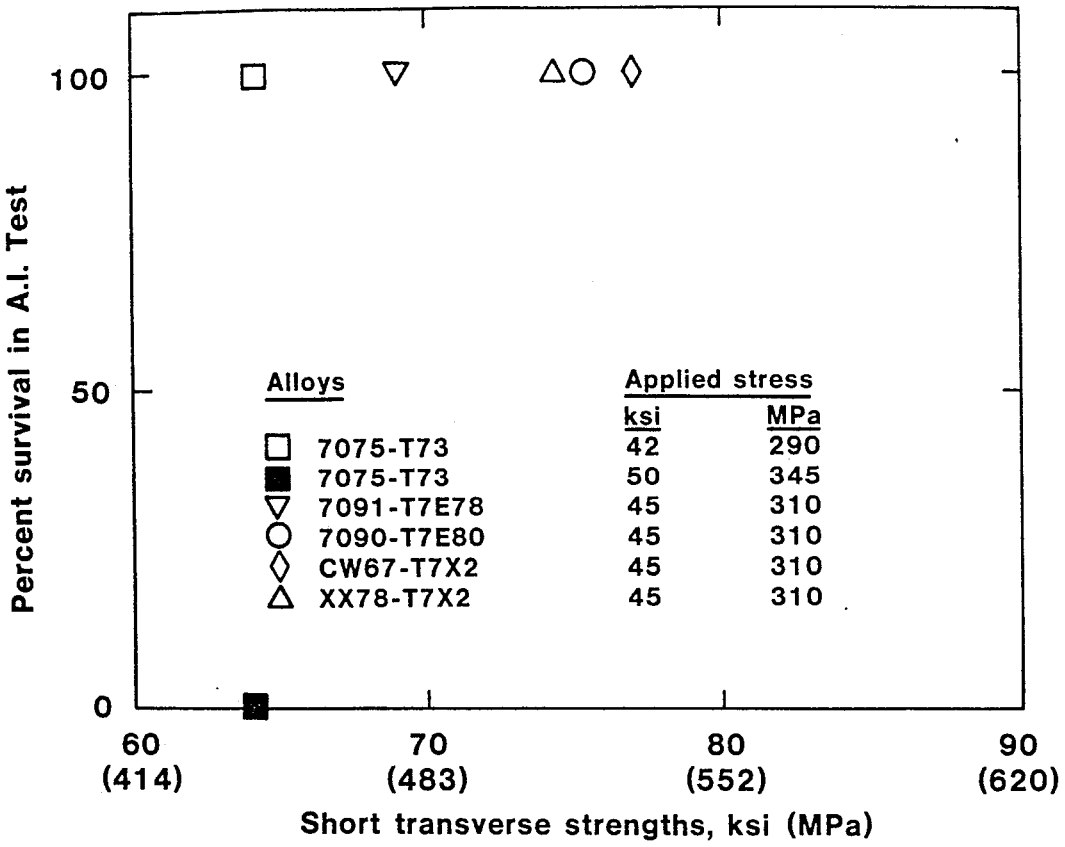

FIG. 4 demonstrates that the stress corrosion cracking (SCC) resistance of CW67 and XX78 in the T7 temper is also excellent. The plot shows that replicate short-transverse specimens from 7075, 7091, 7090, CW67 and XX78 forgings did not fail when exposed for 30 days to a 3.5% salt solution at applied stress levels below 345 MPa. In this comparison, the SCC resistance of CW67 and XX78 is shown to be comparable to 7090 which is an alloy known for its superior resistance to stress corrosion cracking compared to 7075.

Figure 5:
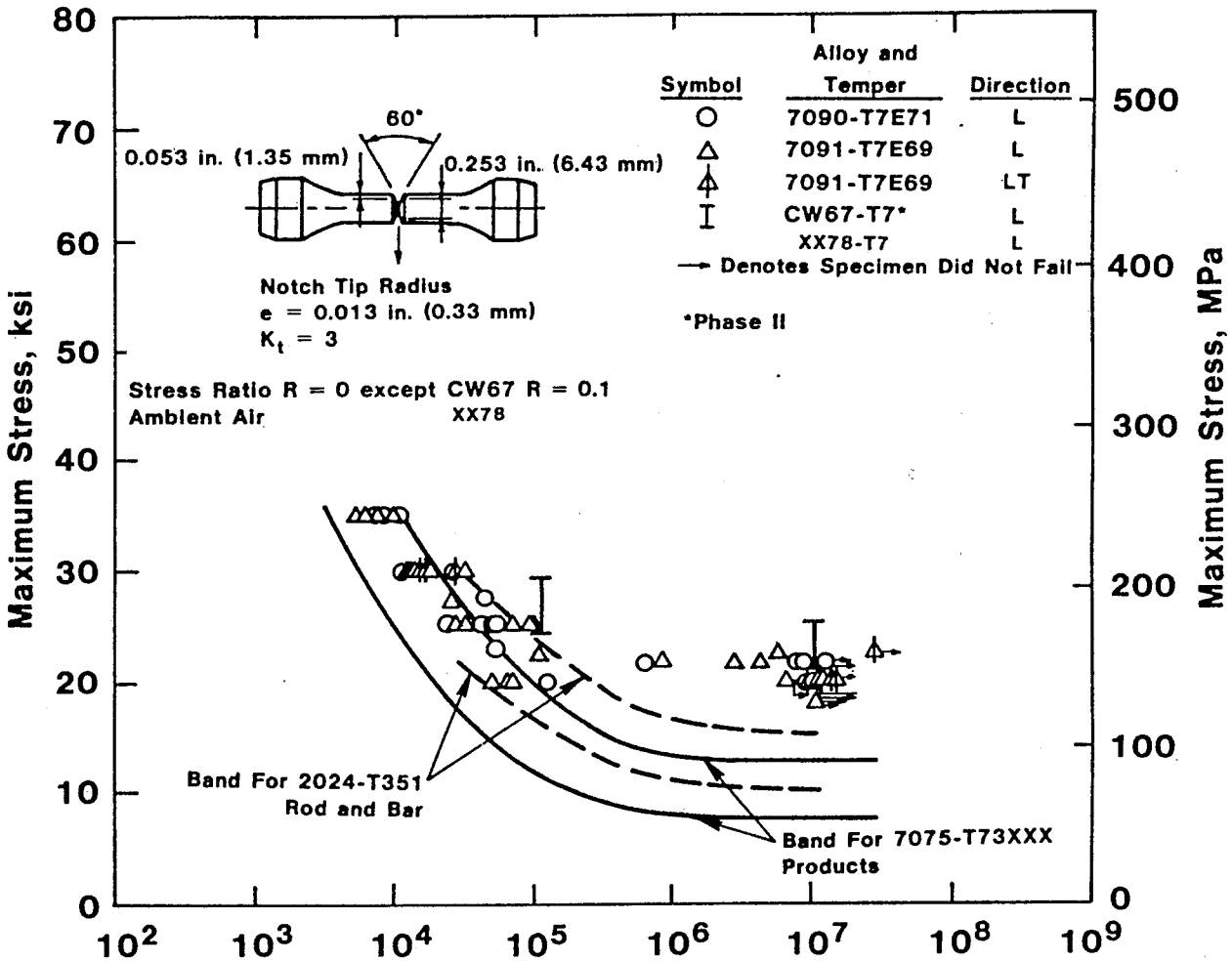

FIG. 5 shows the improvement in notched axial S-N fatigue strength for powder metallurgy alloys CW67-T7 and XX78-T7 over 2024-T351 and 7075-T73. At $10^5$ cycles and greater, the powder metallurgy alloys exhibit greater fatigue strength relative to conventional ingot metallurgy alloys used in aircraft.

Figure 6:
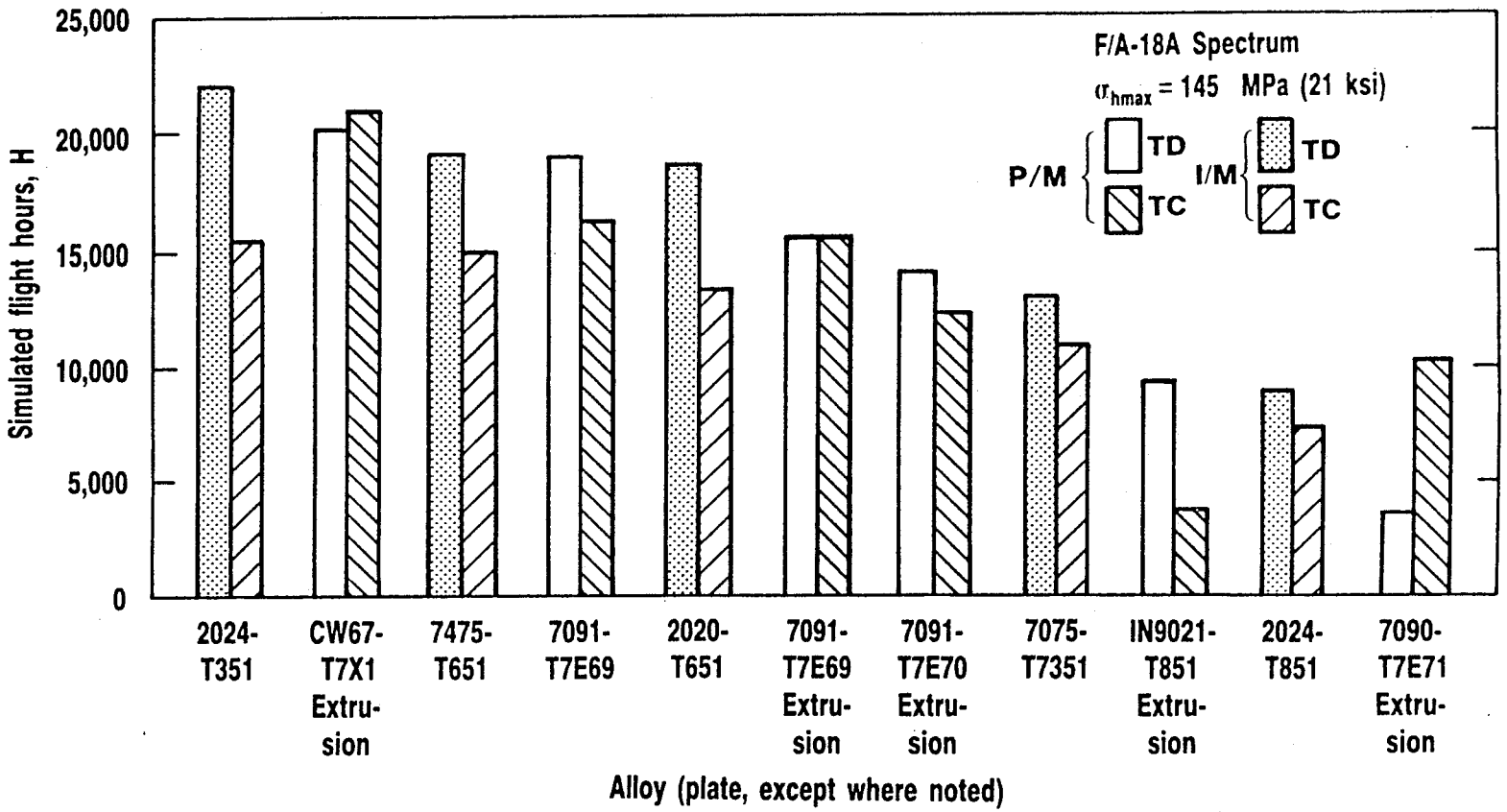

Another alloy property which is important to aerospace applications is fatigue crack growth. FIG. 6 shows that in spectrum fatigue crack growth tests carried out according to specifications of Northrop Corporation, CW67 exhibits better resistance to fatigue crack growth (as demonstrated by a greater number of simulated flight hours) than any other 7XXX alloy. In both tension-dominated (TD) and in tension-compression (TC) spectrums, CW67 demonstrated longer life compared to a wide variety of ingot and powder metallurgy alloys.

INDUSTRIAL APPLICABILITY

It will be obvious from what has been described above that the invention has wide industrial applicability particularly in the form of, for example, aircraft parts where its special combination of properties make its use quite attractive. For example, to save weight in aircraft, a higher strength alloy is desired so a lighter part with a smaller section size can be substituted without a loss of fracture toughness, corrosion resistance or fatigue properties. Therefore, alloy of the invention can be used in extrusions, forgings, sheet, plate and other product forms where the combination of high strength, toughness, corrosion resistance and fatigue properties are important.

While the invention has been described in terms of preferred embodiments, the claims appended hereto are intended to encompass all embodiments which fall within the spirit of the invention.

What is claimed is:

1. Loose metal particles of an aluminum alloy consisting essentially of about 5 to 13% zinc, 1 to 3.5% magnesium, 0.5 to 3.0% copper, with iron being present up to 0.5%, with silicon being present up to 0.4%, plus nickel or cobalt or both being present in an amount effective essentially to place the iron in the incoherent dispersoid $Al_9(Fe,M)_2$, M being nickel or cobalt or both, M being present up to 0.75%, pluls means being present for forming coherent dispersoids, said means being present up to 1%, balance aluminum, said means being at least one of the elements Zr, V, Hf, Ta, and Ti.

2. Metal particles as claimed in claim 1, which, when consolidated, exhibit in a T7 temper a combination of properties compared to 7075-T7 alloy products such that there is an improvement in fracture toughness of at least 5%, an improvement in yield strength of at least 10%, an improvement in fatigue strength at $10^5$ cycles, K=3, R=0.1, of at least 10%, with equivalent or superior corrosion resistance.

3. Metal particles as claimed in claim 1, which, when consolidated, exhibit in a T7 temper a combination of properties compared to 7075-T7 alloy products such that there is an improvement in fracture toughness of at least 10%, an improvement in yield strength of at least 20%, an improvement in fatigue strength at $10^5$ cycles, K=3, R=0.1, of at least 20%, with equivalent or superior corrosion resistance.

4. Metal particles as claimed in claim 1, which, when consolidated, exhibit in a T6 temper a combination of properties compared to 7075-T6 alloy products such that there is an improvement in fracture toughness of at least 5%, an improvement in yield strength of at least 10%, an improvement in fatigue strength at $10^5$ cycles, $K_t=3$, R=0.1, of at least 10%, with equivalent or superior corrosion resistance.

5. Metal particles as claimed in claim 1, which, when consolidated, exhibit in a T6 temper a combination of properties compared to 7075-T6 alloy products such that there is an improvement in fracture toughness of at least 10%, an improvement in yield strength of at least 20%, an improvement in fatigue strength at $10^5$ cycles, $K_t=3$, R=0.1, of at least 20%, with equivalent or superior corrosion resistance.

6. Metal particles as claimed in claim 1, further containing up to 1.0 oxygen.

7. Metal particles as claimed in claim 1, containing 0.05 to 0.3% total of said elements.

8. Metal particles as claimed in claim 7, containing 0.1 to 0.2% total of said elements.

9. Metal particles as claimed in claim 1, wherein the weight ratio Ni/Fe is between 0.8:1 and 4.5:1.

10. Metal particles as claimed in claim 1, iron being present up to 0.2%, silicon being present up to 0.2%.

11. Metal particles as claimed in claim 1, iron being present up to 0.1%, silicon being present up to 0.1%.

12. A consolidated alulminum alloy metal particle composition consisting essentially of about 5 to 13% zinc, 1 to 3.5% magnesium, 0.5 3.0% copper, with iron being present up to 0.5%, with silicon being present up to 0.4%, plus nickel or cobalt or both being present in an amount effective essentially to place the iron in the incoherent dispersoid $Al_9(Fe,M)_2$, M being nickel or cobalt or both, M being present up to 0.75%, plus means being present up to 1%, balance aluminum, said means being at least one of the elements Zr, V, Hf, Ta, and Ti.

13. A composition as claimed in claim 12, exhibiting in a T7 temper a combination of properties compared to 7075-T7 alloy products such that there is an improvement in fracture toughness of at least 5%, an improvement in yield strength of at least 10%, an improvement in fatigue strength at $10^5$ cycles, $K_t=3$, R=0.1, of at least 10%, with equivalent or superior corrosion resistance.

14. A composition as claimed in claim 12, exhibiting in a T7 temper a combination of properties compared to 7075-T7 alloy products such that there is an improvement in fracture toughness of at least 10%, an improvement in yield strength of at least 20%, an improvement in fatigue strength at $10^5$ cycles $K_t=3$, R=0.1, of at least 20%, with equivalent or superior corrosion resistance.

15. A composition as claimed in claim 12, exhibiting in a T6 temper a combination of properties compared to 7075-T6 alloy products such that there is an improvement in fracture toughness of at least 5%, an improvement in yield strength of at least 10%, an improvement in fatigue strength at $10^5$ cycles, $K_t=3$, =0.1, of at least 10%, with equivalent or superior corrosion resistance.

16. A composition as claimed in claim 12, exhibiting in a T6 temper a combination of properties compared to 7075-T6 alloy products such that there is an improvement in fracture toughness of at least 10%, an improvement in yield strength of at least 20%, an improvement in fatigue strenght at $10^5$ cycles, $K_t=3$, R=0.1, of at least 20%, with equivalent or superior corrosion resistance.

17. A composition as claimed in claim 12, further containing up to 1.0 oxygen.

18. A composition as claimed in claim 1, containing 0.05 to 0.3% total of said elements.

19. A composition as claimed in claim 18, containing 0.1 to 0.2% total of said elements.

20. A composition as claimed in claim 12, wherein the weight ratio Ni/Fe is between 0.8:1 and 4.5:1.

21. A composition as claimed in claim 12, iron being present up to 0.2%, silicon being present up to 0.2%.

22. A composition as claimed in claim 12, iron being present up to 0.1%, silicon being present up to 0.1%.

* * * * *

UNITED STATES PATENT AND TRADEMARK OFFICE

CERTIFICATE OF CORRECTION

PATENT NO. : 4,732,610

DATED : March 22, 1988

INVENTOR(S) : Gregory J. Hildeman et al

It is certified that error appears in the above-identified patent and that said Letters Patent is hereby corrected as shown below:

| | |
|---|---|
| Col. 4, line 20 | change "7XXXX" to --7XXX--. |
| Col. 4, line 30 | change "7075T73XXX" to --7075-T73XXX--. |
| Col. 6, cl. 1, ln. 55 | change "pluls" to --plus--. |
| Col. 6, cl. 2, ln. 65 | change "K = 3" to --$K_t$ = 3--. |
| Col. 7, cl. 3, ln. 5 | change "K = 3" to --$K_t$ = 3--. |
| Col. 7, cl. 12, ln. 37 | change "0.5 3.0%" to --0.5 to 3.0%--. |
| Col. 7, cl. 12, ln. 43 | after "present" insert --for forming coherent dispersoids, said means being present--. |
| Col. 8, cl. 16, ln. 29 | change "strenght" to --strength--. |
| Col. 8, cl. 18, ln. 34 | change "claim 1" to --claim 12--. |

Signed and Sealed this

Ninth Day of August, 1988

*Attest:*

*Attesting Officer*

DONALD J. QUIGG

*Commissioner of Patents and Trademarks*